US008365932B2

(12) United States Patent
Lancesseur et al.

(10) Patent No.: US 8,365,932 B2
(45) Date of Patent: Feb. 5, 2013

(54) DEVICE FOR THE LEAK-TIGHT SEALING OF PACKAGING CONTAINERS FOR SENSITIVE PRODUCTS

(75) Inventors: Didier Lancesseur, Boulogne (FR); Stephane Rault, Paris (FR); Sebastien Brogly, Geovreissiat (FR)

(73) Assignee: Airsec S.A., Choisy le Roi (FR)

( * ) Notice: Subject to any disclaimer, the term of this patent is extended or adjusted under 35 U.S.C. 154(b) by 1262 days.

(21) Appl. No.: 10/583,362

(22) PCT Filed: Dec. 20, 2004

(86) PCT No.: PCT/FR2004/003307
§ 371 (c)(1),
(2), (4) Date: Apr. 27, 2007

(87) PCT Pub. No.: WO2005/061343
PCT Pub. Date: Jul. 7, 2005

(65) Prior Publication Data

US 2007/0272646 A1 Nov. 29, 2007

(30) Foreign Application Priority Data

Dec. 19, 2003 (FR) ..... 03 14987

(51) Int. Cl.
*B65D 55/02* (2006.01)

(52) U.S. Cl. ..... 215/235; 215/237

(58) Field of Classification Search ..... 206/204, 206/213.1; 220/521, 254.3, 375, 838; 215/235, 215/237, 306, 355, 250, 257, 256
See application file for complete search history.

(56) References Cited

U.S. PATENT DOCUMENTS

| | | | | |
|---|---|---|---|---|
| 4,345,607 | A | 8/1982 | Contreras et al. | |
| 4,498,608 | A | 2/1985 | Mercil | |
| 4,589,431 | A | 5/1986 | Yuhara | |
| 4,591,078 | A * | 5/1986 | Weissman | 222/517 |
| 4,834,234 | A * | 5/1989 | Sacherer et al. | 206/204 |
| 4,934,556 | A | 6/1990 | Kleissendorf | |

(Continued)

FOREIGN PATENT DOCUMENTS

| | | |
|---|---|---|
| CA | 2107055 | 8/1994 |
| DE | 9317569 | 1/1994 |

(Continued)

OTHER PUBLICATIONS

Amendment filed Aug. 20, 2009 in response to Final Office Action dated May 8, 2009 issued with respect to U.S. Appl. No. 10/566,093, a "potentially related" application disclosed in an information Disclosure Statement filed on Mar. 26, 2009.

(Continued)

*Primary Examiner* — Steven A. Reynolds
*Assistant Examiner* — King M Chu
(74) *Attorney, Agent, or Firm* — Scott R. Cox

(57) ABSTRACT

The invention relates to a device for the leak-tight sealing of openings in containers and for the purification of the ambient air located therein as a result of opening and closing cycles, said containers being intended for the packaging of products that are sensitive to gaseous pollutants present in the ambient air. The inventive device is particularly suitable for the packaging of solid-state medicaments in the form of pellets, tablets or capsules, having a reactivity and physical integrity that must be fully conserved.

26 Claims, 9 Drawing Sheets

U.S. PATENT DOCUMENTS

| | | | | |
|---|---|---|---|---|
| 4,940,167 | A | 7/1990 | Fillmore et al. | |
| 5,322,176 | A * | 6/1994 | Dubach | 215/235 |
| 5,423,442 | A * | 6/1995 | Nozawa et al. | 215/235 |
| 5,435,456 | A * | 7/1995 | Dubach | 220/838 |
| 5,464,112 | A * | 11/1995 | Guillot | 215/254 |
| 5,605,240 | A | 2/1997 | Guglielmini et al. | |
| 5,836,465 | A | 11/1998 | King | |
| 5,894,949 | A * | 4/1999 | Taskis et al. | 215/247 |
| 5,947,274 | A | 9/1999 | Taskis et al. | |
| 6,000,550 | A | 12/1999 | Simpson et al. | |
| 6,070,749 | A | 6/2000 | Joulia | |
| 6,461,026 | B1 | 10/2002 | Wang | |
| 6,631,820 | B2 * | 10/2003 | Harrold et al. | 215/237 |
| 2003/0029739 | A1 | 2/2003 | Riemenschneider et al. | |
| 2004/0065669 | A1 | 4/2004 | Giraud et al. | |

FOREIGN PATENT DOCUMENTS

| | | | |
|---|---|---|---|
| EP | 0379775 | | 8/1990 |
| EP | 0454967 | A2 | 11/1991 |
| EP | 0824480 | B1 | 2/1998 |
| EP | 1352844 | A1 | 10/2003 |
| EP | 1616810 | | 1/2006 |
| FR | 2134660 | | 12/1972 |
| FR | 2705646 | | 12/1994 |
| FR | 2812620 | | 2/2002 |
| GB | 248223 | | 3/1926 |
| GB | 812580 | | 4/1959 |
| GB | 2224309 | | 5/1990 |
| GB | 2265890 | | 10/1993 |
| WO | WO8908057 | A1 | 9/1989 |
| WO | WO 93/23305 | | 11/1993 |
| WO | 0126973 | | 4/2001 |
| WO | 2004094257 | | 11/2004 |
| WO | WO2004096658 | A1 | 11/2004 |

OTHER PUBLICATIONS

Preliminary Amendment filed Oct. 8, 2009 in response to Final Office Action dated May 8, 2009 issued with respect to U.S. Appl. No. 10/566,093, a "potentially related" application disclosed in an Information Disclosure Statement filed on Mar. 26, 2009.

Office Action dated Jul. 13, 2010 with respect to U.S. Appl. No. 12/518,922.

Response dated Oct. 12, 2010 to Office Action dated Jul. 13, 2010 with respect to U.S. Appl. No. 12/518,922.

Office Action dated Apr. 24, 2008 with respect to U.S. Appl. No. 10/566,093.

Response filed Aug. 25, 2008 in response to Office Action dated Apr. 24, 2008 with respect to U.S. Appl. No. 10/566,093.

Final Office Action dated Nov. 10, 2008 with respect to U.S. Appl. No. 10/566,093.

Preliminary Amendment filed Feb. 10, 2009 with Request for Continuing Examination with respect to U.S. Appl. No. 10/566,093.

English translation of International Preliminary Report on Patentability pertaining to international application No. PCT/EP2008/056894. See reference to U.S. Appl. No. 12/666,514 in the Information Disclosure Statement filed herewith. This IPRP may contain information material to the patentability of the current application.

Final Office Action dated May 8, 2009 issued with respect to U.S. Appl. No. 10/566,093, a "potentially related" application disclosed in an Information Disclosure Statement filed on Mar. 26, 2009.

* cited by examiner

DEVICE FOR THE LEAK-TIGHT SEALING OF PACKAGING CONTAINERS FOR SENSITIVE PRODUCTS

CROSS REFERENCE TO RELATED APPLICATIONS

This application is a §371 National Stage application of International Application No. PCT/FR04/03307 filed Dec. 20, 2004 which claims priority to French Application No. 0314987 filed Dec. 19, 2003.

BACKGROUND OF THE INVENTION

1.Field of the Invention

The invention relates to a device for the leak-tight sealing of openings in containers and for the purification treatment of ambient air located therein as a result of opening and closing cycles, these containers being intended for packaging of products that are sensitive to gaseous pollutants present in this ambient air.

2.Description of Related Art

The invention is related particularly to a device for leak-tight sealing of the access opening in containers and for purification treatment of ambient air located in these containers as a result of opening and closing cycles, these containers being intended for packaging of products sensitive to gaseous pollutants. This leak-tight sealing and purification treatment device is composed of the following, according to a new combination of known or unknown means:

- a leak-tight sealing means in the container access opening,
- a means of assembly of the sealing device on the container access opening,
- a means of connection between the sealing means and the assembly means of the device,
- at least one means of checking tamper resistance
- a mechanical assistance means controlling the amplitude of the opening angle and assisting with opening and closing of the said sealing means.

The leak-tight sealing and purification treatment device is a single part made of thermoplastic materials using plastics technologies.

In the following and throughout the description of the object according to the invention:

- The gaseous pollutants that may be present in the ambient air in the leak-tight packaging containers for sensitive products may for example be water vapour, oxygen ($O_2$), ammonia ($NH_3$), alcohols, aldehydes, ketones, sulphur dioxide ($SO_2$), hydrogen sulphide ($H_2S$), mercaptans, alkenes particularly including ethylene, alkynes, carbon dioxide ($CO_2$), carbon monoxide (CO), nitrogen dioxide ($NO_2$), alkanes and particularly methane ($CH_4$), halogens and particularly fluorine, bacteria in suspension in the ambient air and others.
- Products sensitive to gaseous pollutants present in the ambient air may be defined as being:
  - materials in the solid state, in a wide variety of forms such as powdery, granules, pellets, particularly for effervescent, sugar-coated or agglomerated products, and/or
  - objects that may be in various shapes and particularly oblong shapes.

Thus, and according to this definition:

- Materials sensitive to pollutants like those mentioned above to be packaged in a leak-tight container are usually medicaments, particularly effervescent medicaments, that should be protected so that their reactive effectiveness does not change in time due to reaction with at least one of the pollutants, and/or so that their physical integrity is maintained in the long term, and for example to avoid a change to their mechanical cohesion.
- Objects sensitive to pollutants, to be packaged in a leak-tight container are particularly oblong in shape, and they may have an approximately polygonal, circular, elliptical or elongated cross-section and are consumables. Such objects include particularly small tongues, reactive bands or rigid lamellae used for example for diagnosis or checking purposes in the medical field, dressings, food products such as chewing-gum, tooth picks, small sticks or others.

For obvious reasons, particularly hygiene reasons but also to prevent any degradation and thus improve the conservation life of products sensitive to pollutants present in ambient air, these products are placed in containers protected from physicochemical attacks caused by the concentration of gaseous pollutants, but also protected from light, particularly UV rays, or from degradation due to mechanical causes such as shocks.

Establishment of the state of the art demonstrates the existence of stoppers for closing containers, the essential function of which is that they have drying properties: these particular containers are designed to receive and contain products sensitive to ambient humidity, that must be protected by creating the driest possible internal ambient atmosphere to prevent a regain of humidity, since such regain of humidity by absorption could in particular react with the said products and reduce their reactivity causing mechanical weakness under shock, spalling or disintegration in the container.

Many products are particularly sensitive to ambient humidity, and for example and more precisely may include medicament test materials in powdery form or in more sophisticated forms such as granules, tablets, pellets, oblong shaped objects such as bands for tests or other purposes, more specifically including products that are particularly sensitive to humidity.

These drying and leak-tight containers according to the state of the art for the storage of products sensitive to ambient humidity are tubular shaped or may be in any other shape and, provided with an opening, are closed off by a stopper that may or may not be fixed to the tubular part through a solidarisation means such as a narrow flexible strip made from a polymer material identical to the material from which the container and the stopper are made.

These drying and leak-tight containers are provided with internal drying means that are either a coating or insert made using a drying thermoplastic polymer composition placed inside the containers on the inner surface of the bottom of the tube and/or on the inner surface of the sidewall of the tube, or a drying granular material placed in a particular housing on the inner surface of the stopper.

All these drying means are put into place separately or simultaneously to increase their dehydrating efficiency due to a mass effect.

These closed containers are formed from:

- a tubular casing provided with a bottom at one of its ends, the other end being left open so that the said casing can be filled,
- and a closing means that may be a removable stopper that fits into the open end of the tubular casing, or a stopper-cap that also fits into the open end but is connected to the tubular casing by a flexible link such as a narrow flexible polymer strip acting as a hinge.

All these containers and their removable or connected closing means are made from thermoplastic polymer compositions according to techniques well known in plastics techniques.

Means of sealing containers and the drying containers closed by these means for packaging materials and/or objects sensitive to ambient humidity, are described in the state of the art and are distinguished from each other essentially by their architecture, particularly by drying means used in the said containers and by the architecture of the container closing means.

According to a first type of drying container sealing means used in the state of the art, this first closing means is a male type stopper-cap connected to the tubular part of the casing of the drying container through a mechanical means composed of a force fitting ring surrounding the said tubular casing and a flexible and narrow connecting strip between the stopper-cap and the ring, the drying container being formed from a tubular casing open at one of its ends to provide access to the receptacle area.

A document (U.S. Pat. No. 4,934,556) describes such a sealing means and a drying container closed by this means, the closed assembly forming the container being composed of:

- a sealing means comprising a male type stopper-cap, a ring for a force fitting of the said stopper-cap on the tubular casing of the container, a tamper resistance telltale to be torn off, connecting the assembly ring to the outer periphery of the stopper-cap and a flexible strip acting as a narrow connecting hinge between the stopper-cap and the said ring, the sealing means being made from a thermoplastic polymer material that may be different from the material used to make the tubular casing;
- a tubular casing made of a thermoplastic polymer material, provided with a bottom at one of its ends and open at other end, acting as a receptacle for the materials to be packaged, on which the sealing means is installed through the ring.

The male type stopper-cap is formed from a bottom and a descending peripheral skirt called the outer skirt that delimit a cylindrical cavity inside which there is a housing containing a powdery drying agent in direct contact with the internal gaseous medium to be dehydrated.

The sealing means comprising the stopper-cap, the force fitting assembly ring, the tamper resistance telltale, and a single, flexible, narrow connecting strip connecting the stopper-cap to the ring forms an assembly made of a thermoplastic polymer material independent from the tubular casing forming the receptacle of the drying container.

This type of drying stopper-cap designed to close a tubular casing used for packaging of products sensitive to humidity raises uncertainties about its capability to guarantee fast and complete desiccation of the said products when opening/closing the said packaging container. This fact appears to be:

- the result of insufficient leak-tightness between the male type stopper-cap and the tubular casing, since the architecture of the said stopper-cap does not appear to be suitable for making the container leak-tight when external-internal exchanges of gaseous volumes containing humidity that should be quickly dehydrated;
- also, at least partly, the consequence of the flexible connecting means between the cover-cap and the force fitting ring surrounding the casing, since it is impossible to achieve correct positioning of this means consisting of a narrow flexible strip made of a polymer material acting as a hinge when closing the casing, due to lack of any guidance prior to the said closing.

This type of stopper-cap also requires a manipulation of the closed container with two hands, both to open it and to close it.

Another type of drying container sealing means known in the state of the art is a female type stopper-cap fixed to the drying container casing through a means consisting of a narrow flexible connecting strip, the tubular casing, the stopper-cap and the connecting means being made by injection with the same thermoplastic polymer material.

A document (EP 1 352 844) describes such a type of drying container closing means, the closed assembly forming the container being composed of:

- a tubular casing made of a thermoplastic polymer material provided with a bottom at one of its ends and open at the other end;
- a female type stopper-cap without a descending inner skirt that covers the wall of the open end of the container casing when in the closed position, leak-tightness being capable of being assured by the contact between the inner surface of the bottom of the cap of the stopper-cap and the periphery of the open end of the tubular casing, the said stopper-cap being provided with a perforated cavity on its inner surface into which a drying agent in pellet form can be added and connected to the casing through a link consisting of a narrow flexible polymer strip, the casing, the cap and the connection between the cap and the casing being made in a single part during a single plastics forming operation, for example by injection moulding;
- a drying insert consisting of a thermoplastic polymer material containing drying materials, this insert possibly covering the bottom and the inner wall of the said casing simultaneously;
- the stopper-cap without a descending inner peripheral skirt cannot create a surface-to-surface type leak-tightness with the inner surface of the open end of the tubular casing, leak-tightness is apparently only obtained through contact between the inner surface of the bottom of the stopper-cap and the periphery of the open end of the casing;
- the stopper-cap is not particularly suitable for creating leak-tightness between the inside and the outside of the container due to its architecture, but also due to its flexible connecting means with the casing, since this means cannot be used to position the cap when it is closed due to this very high flexibility and consequently the lack of sufficient longitudinal and lateral mechanical stiffness necessary for guidance of the stopper-cap at the time that it is closed;
- it requires the use of two hands to manipulate the closed container for opening and closing.

Another document (GB 2 224 309) describes a hinged sealing device, in other words a stopper for a thermoplastic container and more particularly for containers comprising a very narrow, coaxial distribution opening and intended for distribution of liquid. The stopper comprises a tubular peripheral wall on the inner surface of its upper end with a section adapted to the section of the narrow distribution opening to be sealed, and making the stopper leak-tight when the stopper is in the closed position.

The said device is composed of two parts, the first part being a click fitting cap pivoting on two hinges composed of two flexible strips defining a first rotation axis, the second part being a base to be fixed on the opening of a container to be sealed, and a flexible and elastic link making the connection between these two members and being such that the stopper can occupy two rest positions, one closed and the other open, on each side of an intermediate position occupied during the movement.

The said flexible link with a return function is "S" shaped and is connected semi-rigidly and elastically firstly to the stopper at a precise point, and secondly to the outer surface of the base at another precise point. The connection between the ends of the flexible link firstly to the stopper and secondly to the outer surface of the base is characterised by the lack of hinges due to the continuity of the thickness of the wall.

However, this device has several disadvantages that can be the result of a form of embrittlement of the material forming the flexible link. The "S" shape of the flexible link when the device changes from a closed position to an open position contributes to creating two opposing forces about an inflection point located approximately at the middle of the flexible link, this inflection point delimiting a convex area of the strip on the downstream side and an area of the strip on the upstream side that remains concave.

Thus, the slope inversion due to the "S" deformation at the time of closure causes an acceleration of the movement acting on the convex part of the strip, in other words between the cap and the inflection point, to restore the initial stable concave state of the entire strip.

Therefore this type of flexible link performing the return function is deformed by the slope inversion over its entire length, this total and constant mechanical mobilisation of the material from which the flexible link is made tending to weaken it.

Thus, apparently none of the drying stoppers-caps according to the state of the art is adequate for packaging products sensitive to relative humidity and/or other gaseous pollutants in appropriate containers under optimum conditions, and to enable these containers to develop remarkable characteristics such as:

- quickly absorbing humidity and/or gaseous pollutants, particularly the pollutants mentioned above in a container even after a fast opening/closing cycle,
- easy manipulation of the said stoppers-caps with a single hand and keeping the container sealed, and
- providing mechanical assistance with opening/closing the stopper-cap.

Many objectives are assigned to the leak-tight sealing device according to the invention for packaging containers and for purification treatment of the ambient air located in the container by elimination of the gaseous pollutants present, such that it minimises the above mentioned disadvantages and provides appropriate solutions better than the solutions provided with the various means used in sealing devices described in the state of the art.

Some of the most important objectives of the sealing device according to the invention for packaging containers for products sensitive to gaseous pollutants are means that in combination assure:

- easy opening/closing of the leak-tight sealing and treatment device by precise mechanical guidance of the sealing means so that sealing takes place precisely with no manual guidance, with excellent positioning,
- mechanically assisted opening/closing of the leak-tight sealing and treatment device to accelerate opening and closing of the sealing means and to limit the amplitude of the opening angle at the end of travel so as to put the sealing means in a suitable position for closing with the use of a single finger of the hand holding the container,
- complete leak-tightness set up between the opening to be closed and the sealing means,
- at least one tamper resistance means of the container before first opening,
- dynamic treatment of gaseous pollutants, and particularly the water vapour present in the container, better than what is observed in the state of the art, in other words with a greater capacity to eliminate internal pollution created when the container is opened and closed, to prevent packaged products sensitive to gaseous pollutants from adsorbing and/or reacting partly with the said pollutants and an ability to keep the content of gaseous pollutants internal to the container at a low and relatively constant level, except during opening/closing cycles, to provide the best possible protection to the packaged products sensitive to these pollutants.

SUMMARY OF THE INVENTION

Objectives mentioned above can be achieved by the device for leak-tight sealing of containers and purification treatment of ambient air in the containers used to package the fabricated or other products sensitive to gaseous pollutants.

According to the invention, the device for leak-tight sealing and purification treatment of ambient air in the packaging containers for products sensitive to ambient pollutants, with controlled amplitude of the opening angle and with mechanically assisted opening and closing, made from thermoplastic polymer materials, to be installed on the tubular casing of the access opening to the said containers, comprises:

- a leak-tight sealing means of the access opening of the container, with a means of packaging ambient air treatment agent(s), on its inner face
- a means of assembly of the sealing means onto the tubular casing of the access opening,
- a connection means between the sealing means and the assembly means,
- a first opening tamper resistance means, placed between the sealing means and the assembly means, and is characterised in that it comprises:

a) a male type stopper-cap as the sealing means of the opening in the tubular casing of the container, composed of an upper end wall on which a first coaxial peripheral wall is mounted setting up a leak-tight contact with the inner surface of the tubular casing of the container access opening, and a second wall internal to the first wall, forming the packaging means for the ambient air treatment agents, b) as the assembly means of the sealing means, an assembly ring mounted on the tubular casing of the access opening, the inner face of which is provided with a means of attachment of the outer face of the casing, c) as connection means between the assembly means and the sealing means, two distinct hinges at a spacing from each other, d) as first opening tamper resistance means, a peripheral series of connecting micro-dots or a peripheral strip to be torn off, or a combination of these two means placed between the sealing means and the assembly means, e) a mechanical assistance means for opening and closing and controlling the amplitude of the opening angle of the sealing means, placed in the space located between the two hinges and simultaneously connected to the stopper-cap through a film hinge, and to the attachment ring fastening the device onto the casing by another film hinge, the section through the said mechanical assistance means being in the form of a bracket.

DETAILED DESCRIPTION OF A PREFERRED EMBODIMENT

The various objectives assigned to the object of the invention are the result of insufficiencies demonstrated during use of drying containers according to the state of the art for packaging of products sensitive to ambient humidity and sealed by stoppers-caps fitted with film hinges.

Among these insufficiencies that occur in containers and their sealing device according to the state of the art, the following latent problems are observed:

- impossibility of gripping the container and controlling opening and closing of the stopper-cap with a single hand, particularly to remove one of the first opening tamper resistance telltales,
- absence of mechanical assistance to facilitate opening and closing of the stopper-cap and to control the amplitude of the opening angle of the stopper-cap at the end of its travel distance,
- the lack of precise guidance of the stopper-cap through the use of a flexible hinge as the connecting means between the container and the stopper-cap, that is incapable of assuring suitable positioning of the said stopper-cap at the moment that the container is sealed,
- the more or less fast capability of treating gaseous pollutants present in the ambient air inside the container during opening/closing cycles of the container and
- the efficiency of the sealing means in terms of leak-tightness between long frequency opening/closing cycles to prevent gas/gas exchanges between the inside and the outside of the closed container that could cause a variation of the relative humidity and the content of other gaseous pollutants inside the container.

All these latent problems are solved in the sealing and treatment device according to the invention through a new combination of known or unknown means.

According to the invention, the sealing and purification treatment means created for the container is of the male type, as recommended in the state of the art, but is quite different from the state of the art due to the fact that its new architecture assures a peripheral area of intimate contact with the inner surface of the tubular casing forming the opening of the container to be closed, this area of intimate surface-to-surface type peripheral contact forming an efficient barrier to obtain and to maintain internal leak-tightness of the container.

To achieve this, the chosen sealing means is of the stopper-cap type comprising an upper end wall forming the ceiling of the stopper-cap with a section adapted to the section of the tubular casing that it is to close. This upper end wall is provided with two walls, one called the outer wall and the other called the inner wall, that are peripheral and tubular, concentric and coaxial with the tubular casing.

The first peripheral and tubular wall called the outer wall, creates an intimate peripheral contact area to obtain a surface-to-surface type leak-tightness by setting up a leak-tightness barrier between the inner face of the tubular casing of the access opening and the outer face of the said first wall called the outer wall, of the stopper-cap.

The shape of the cross-section of this first wall called the outer wall comprises a peripheral swelling facing outwards that will come into contact with the inner wall of the tubular casing of the container opening.

When the sealing means or stopper-cap is in the closed position, the peripheral swelling in the first wall called the outer wall is forced into contact with the inner surface of the tubular casing of the opening, preferably being deformed or compressed to a certain extent which increases the contact surface area of the peripheral swelling with the inner surface of the tubular casing of the opening of the container such that the surface-to-surface contact that is firstly tangential may become intimate and immediate during closing by an increase of the contact surface area resulting from sliding and compression of one wall on the other wall, reinforcing the leak-tightness between the sealing device and the container.

An efficient leak-tightness is then set up between the inside and the outside of the container closed by the sealing means according to the invention.

The second wall called the inner peripheral and preferably tubular wall forms an appropriate housing that will contain one or more purification treatment agents, the particular position of this housing being of overriding importance to increase the treatment rate of gaseous pollutants and particularly water vapour.

This appropriate housing, preferably of the tubular type, is located on the inner face of the sealing means or the stopper-cap and is closed by a closing means that is not leak-tight to gaseous pollutants, to assure fast elimination of these pollutants from the container in which the sensitive products to be protected are packaged.

The choice of a drying agent is also of overriding importance so that the container closed by the leak-tight sealing and treatment means according to the invention is very effectively drying in the special case of the treatment of water vapour.

According to the invention, the drying agent used in the container closed by the leak-tight sealing and treatment means is chosen from the group composed of silica gels, molecular sieves in powdery form or deposited on a powdery support.

Known treatment agents appropriate to each pollutant are used in the appropriate housing created on the bottom inner part of the leak-tight sealing and treatment means so that the container closed by the leak-tight sealing and treatment means according to the invention is equally efficient with regard to gaseous pollutants other than water vapour:

- either mixed with the drying agent,
- or separately from the drying agent by creating open compartments in this appropriate housing separating the said housing into sectors each designed to contain a separate treatment agent or mixes of treatment agents compatible with each other.

To facilitate the stopper-cap opening and closing manoeuvre, the plane lower edge of the outer peripheral wall may be extended by a gripping visor.

A child safety opening system can be installed adjacent to the visor, to make it difficult or impossible for children to open the stopper-cap. This device, which may for example be a flexible strip forming an integral part of the assembly means is located underneath the visor such that the projection from the visor used to apply a vertical thrust to open it is surrounded by this flexible strip.

In this case, the visor cannot be accessed until pressure is applied on this strip in order to deform it and provide access to the said visor. With this type of means, the child is protected by the fact that two complementary actions have to be performed simultaneously, the first being a horizontal pressure on the flexible strip, and the second being a vertical upwards thrust on the released visor by maintaining pressure on the flexible strip.

The inner face of the outer wall of the stopper-cap approximately facing the gripping visor and the outer face of the outer wall of the tubular casing of the access opening of the container are provided with a click fit means, requiring a mechanical force both to close the stopper-cap with reinforced leak-tightness and to open it, to keep the stopper-cap in the closed position after it has been opened at least once.

According to the invention, the assembly means of the sealing means or the stopper-cap is formed from an attachment ring mounted on the tubular casing of the access opening to the container to be sealed, this ring:

being sized to match the dimensions of the tubular casing, being provided with a click fit means either recessed or in relief on its inner face that will come into contact with the outer surface of the casing, the click fit means facing the outer face of the casing on which there is an opposed mating means used for click fitting the ring, in other words it is in relief or is recessed, if it is not provided with a click fit means on its inner surface, being accurately adjusted to the size of the casing and force fitted onto the casing, or fixed by a bonding means.

According to one variant of the invention, the outer peripheral surface of the tubular casing of the access opening to the container to be sealed comprises two projecting peripheral collars separated from each other, creating a groove with an approximately rectangular shaped section such that:

the thickness of the tubular casing inside the groove is not modified, and the attachment ring is force fitted into the said groove.

According to another variant of the invention, a peripheral groove that may have an approximately rectangular, hemispherical or semi-elliptical shaped section, is made recessed within the thickness of the wall of the tubular casing of the container such that:

the thickness of the tubular casing inside the groove is modified, and is less than the thickness of the tubular casing and the attachment ring is force fitted into the said groove.

According to another variant of the invention, the inner surface of the attachment ring is provided with click fit means which, when the said attachment ring is force fitted into the groove of the tubular casing of the container, itself equipped with complementary click fit means, fit into the corresponding click fit means so as to block any rotation or translation of the stopper with respect to the container.

The said click fit means present on the inner surface of the attachment ring and on the inner surface of the groove of the container may be of various types such as splines, slots, or others.

According to the invention, a relatively rigid hinge type connecting means is present between the sealing means (or stopper-cap) and the assembly means (an attachment ring) on the tubular casing of the access opening to the container.

The hinge type connecting means according to the invention is formed from two film hinges at a distance from each other, making the connection between the stopper-cap and the attachment ring rigid due to their spacing.

Each film hinge is formed from two parts connected together by a polymer film acting as an axis of rotation to enable opening-closing cycles of the sealing means, one of the parts being integrated into the sealing means and the other part being integrated into the assembly means.

The two parts of each of the two hinges integrated into the sealing means and into the assembly means form attachment brackets for the two film hinges on the sealing means and the assembly means.

These two types of film hinges assure optimum operation during closing (and during opening) and during placement of the stopper-cap on the casing of the opening to be sealed using a single finger of the hand holding the container, due to perfect mechanical guidance of the said stopper-cap not requiring any pressure for closing other than a downwards vertical pressure, which causes click fitting of the stopper-cap. Note that according to the state of the art, two hands are necessary to close or open removable stoppers or stoppers-caps connected to the tubular casing by a single film hinge.

These two film hinges at a spacing from each other form a precision hinge for closing the drying stopper-cap since, due to the rigidity that they create due to their spacing, they guide the drying stopper-cap along a perfect path until it is completely closed, leading to click fitting of the stopper-cap by applying a simple vertical pressure.

According to the invention, the tamper resistance means or the tamper resistance telltale consists of:

either micro-links connecting the lower peripheral surface of the stopper-cap to the upper peripheral surface of the attachment ring, these micro-links being micro-connection dots independent of each other but forming a toothed peripheral connecting ring between the drying sealing means and the assembly means on the tubular casing of the container opening, these micro-dots will be broken during the first opening by application of a breaking force exerted in the upwards direction on the visor, or a tamper resistant ring to be torn off connecting the lower peripheral surface of the stopper-cap to the upper peripheral surface at the attachment ring, or both of the above mentioned tamper resistance means, forming a new combination of tamper resistance means.

According to the invention, a mechanical spring-loaded means for assistance in opening or closing the leak-tight sealing and treatment means is placed in the space between the two previously mentioned film hinges. The section through this mechanical means is bracket shaped with an angle of the order of 90°.

This spring-loaded mechanical means for assisted opening and closing of the leak-tight sealing and treatment means also controls the amplitude of the opening angle of the sealing means, such that when it at its maximum open position, the sealing means is easily moved in the closing direction using one finger of the hand holding the container fitted with the device according to the invention.

The spring-loaded mechanical means is simultaneously connected to the stopper-cap by a film hinge and to the attachment ring of the device according to the invention by another film hinge.

The preferred amplitude of the opening angle controlled by the spring-loaded mechanical means is not more than 160° and is usually between 90° and 160°, unlike the opening angle of a stopper-cap according to the state of the art which is about 180° and often more than this.

The section through the spring-loaded mechanical means is like a tensioned bracket. When the container is opened and closed, the mechanical means shaped like a bracket is slightly deformed at the attachment points of the said mechanical means, in other words at the stopper-cap and at the device attachment ring: the angular deformation of the bracket shaped mechanical means is the same on each side of the bracket and is of the order of not more than 15° on each side and preferably of the order of not more than 9° on each side.

The observed deformation of the angle formed by the bracket between its closed position and its open position is then between 0° and not more than 30° and preferably between 0° and not more than 18°.

Thus, this mechanically assisted opening or closing of the specially shaped sealing means is characterised by its excellent flexibility in operation and enables the said sealing means to be closed smoothly with no sudden jerks, and precise and controlled guidance of the stopper-cap during closing.

The leak-tight and treatment device according to the invention for leak-tight sealing of containers to be used for packaging of products sensitive to ambient humidity is composed of a leak-tight sealing and treatment means, a means of assembly of the sealing means on the opening to be closed, a means of connecting the sealing means and the assembly means, at least one tamper resistance means and a means for mechanical assistance with opening and closing the sealing means and for controlling the opening angle of the sealing means, is made in a single part by plastics manufacturing methods adapted to manufacturing using materials consisting of thermoplastic polymers and/or copolymers, for example such as polyethylenes (PE), polypropylenes (PP), ethylene/propylene copolymers and blends of them, polyamides (PA), polystyrenes (PS), acrylonitrile-butadiene-styrene (ABS) copolymers, styrene-acrylonitrile (SAN) copolymers, polyvinyl chlorides (PVC), polycarbonates (PC), polymethyl methacrylate (PMMA), polyethylene terephthalates (PET) used alone or blended depending on their compatibility.

At least one natural or synthetic thermoplastic elastomer may be associated with these polymers and/or copolymers to make the device, depending on the required mechanical characteristics. The elastomer(s) used may preferably be chosen from a group composed of natural rubber or synthetic rubber type elastomers, and particularly rubbers based on olefins for example such as polymers of isobutene/isoprene, ethylene vinyl acetate (EVA), ethylene-propylene (EPR), ethylene-propylene-diene (EPDM), ethylene-acrylic esters (EMA-EEA), fluorinated polymers, diolefin rubbers such as for example polybutadienes, styrene-butadiene (SBR) copolymers, rubbers based on condensation products such as for example polyester or polyurethane thermoplastic rubbers, silicones, styrenic rubbers, styrene-butadiene-styrene (SBS) and styrene-isoprene-styrene (SIS) and others.

According to the invention, the leak-tight sealing and treatment device and the packaging container to be sealed may be made using polymer materials with the same composition or with polymer materials with different compositions.

The invention will be better understood after reading the detailed description of the Figures given below, these Figures being provided to illustrate a particular device according to the invention and are non-limitative.

Figure 1:
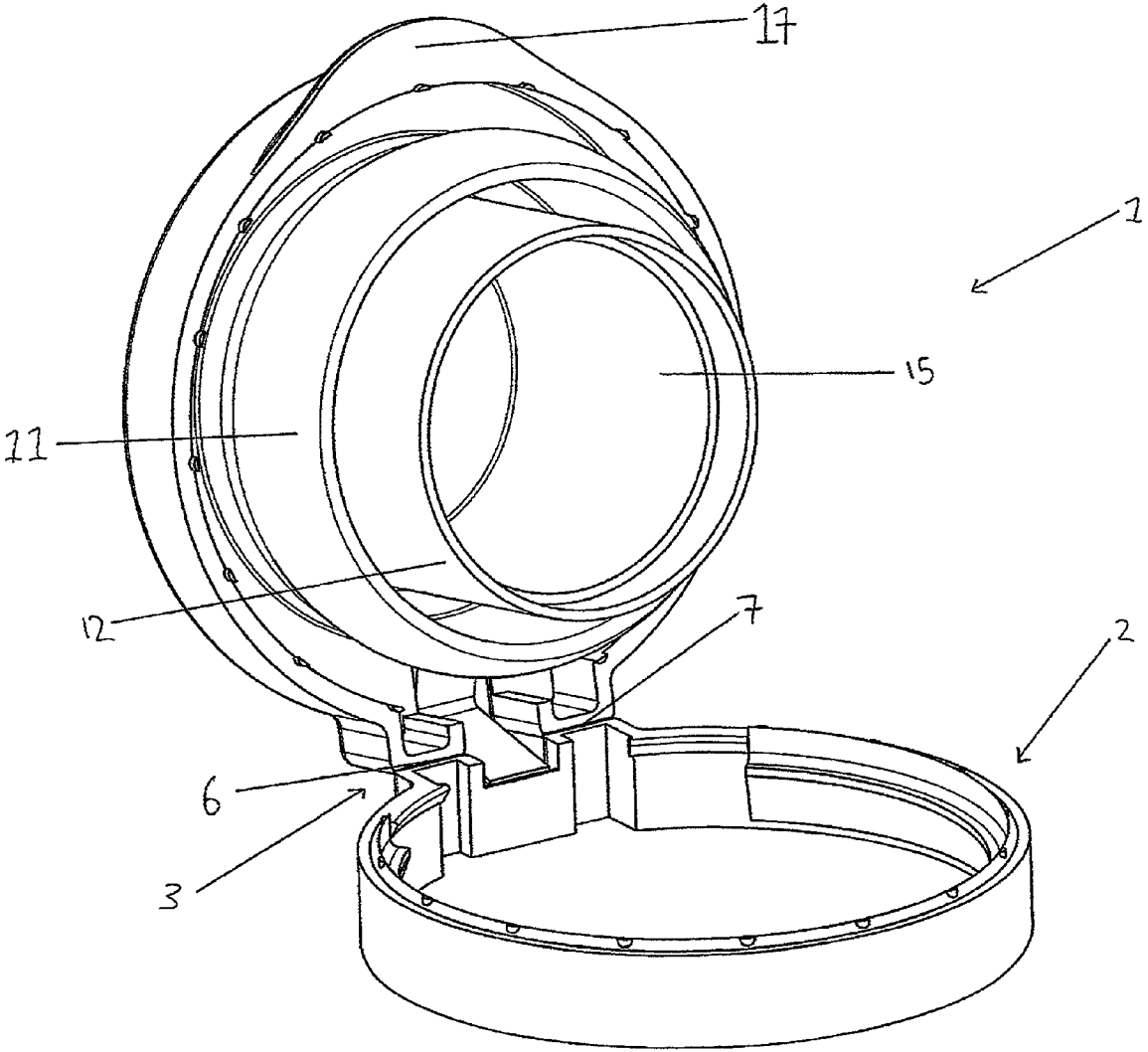
FIG. 1 is a perspective view of the leak-tight sealing and treatment device in the open position.
Figure 2:
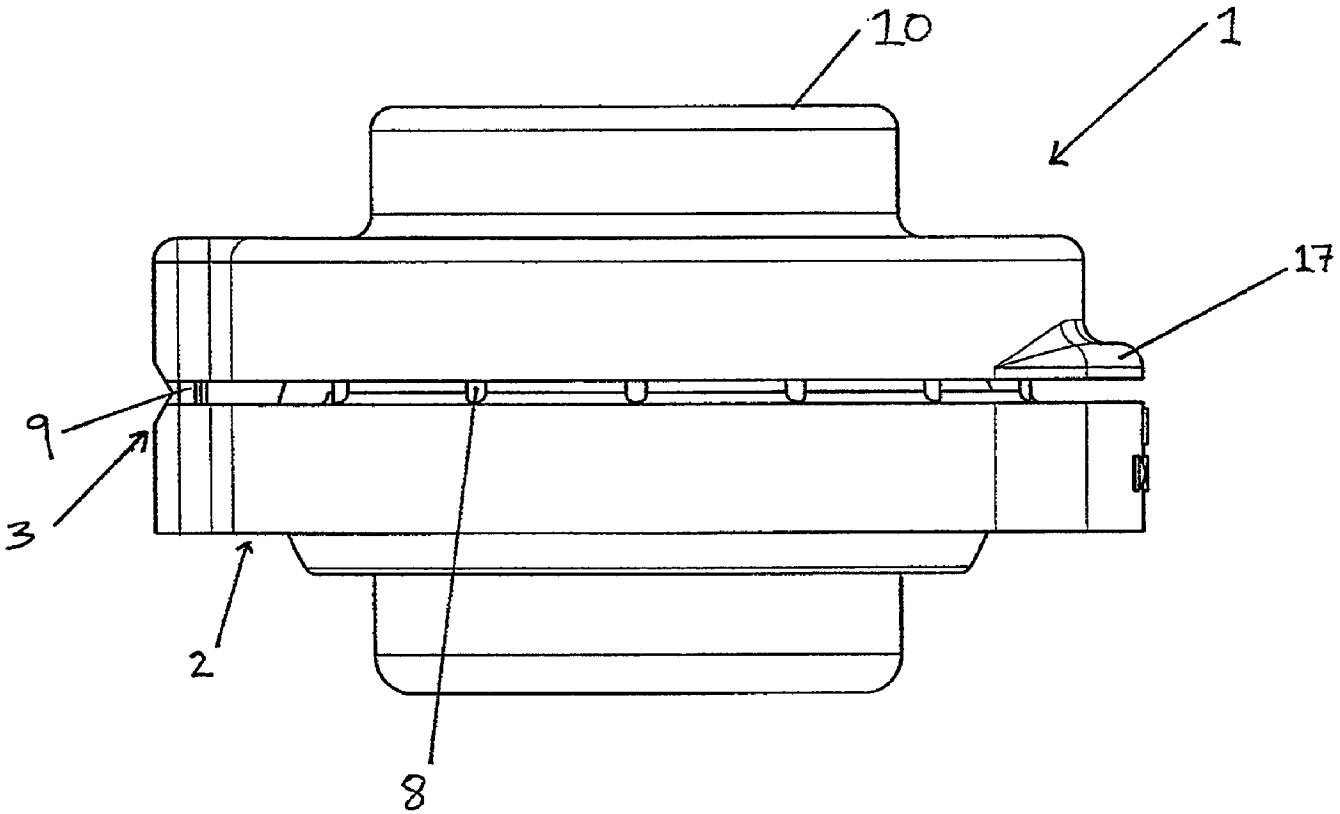
FIG. 2 is a perspective elevation of the leak-tight sealing and treatment device in the closed position before first opening, demonstrating the tamper resistance means.

According to FIGS. 1 to 10, the leak-tight sealing and treatment device for containers consists of a sealing means (1) that is a stopper-cap, an assembly means (2) of the sealing means (1) onto the access opening (4) of the container (5) that is an assembly ring, and a connecting means (3) between the sealing means (1) and the assembly means (2), this connecting means being composed of film hinges (6) and (7), and finally a tamper resistance means (8) at first opening and a mechanical assistance means (9) for opening and closing of the stopper-cap (1), also controlling the opening angle of the said stopper-cap.

The stopper-cap type of sealing means (1) comprises an upper end wall (10) forming its ceiling, provided with two concentric and coaxial peripheral and tubular walls, one of which is called the tubular outer wall (11) and the other the tubular inner wall (12).

The peripheral and tubular outer wall (11) creates an intimate leak-tight peripheral surface-to-surface type contact zone by setting up a leak-tight barrier between the inner face (13) of the tubular casing of the access opening and the outer face of the said outer wall (11).

The sectional shape of this outer wall (11) comprises a peripheral swelling (14) oriented outwards and that will come into contact with the inner face (13) of the tubular casing of the opening of the container.

When the stopper-cap (1) is in the closed position, the peripheral swelling (14) of the outer wall (11) comes into forced contact with the inner face (13) of the tubular casing of the opening, and is deformed and compressed to a certain extent which increases the contact surface area of the peripheral swelling (14) with the inner face (13) of the tubular casing, the surface-to-surface contact becoming total, intimate and immediate on closing, by the outer wall (11) sliding and being compressed on the face (13), creating complete leak-tightness.

The second wall, called the tubular inner wall (12), peripheral and preferably tubular, forms a housing (15) that can hold an agent for the treatment of gaseous pollutants and particularly a drying agent, the particular position of this housing being of overriding importance to increase the rate at which the said gaseous pollutants are eliminated.

This appropriate housing (15) is located on the inner face of the stopper-cap and is closed by a closing means that is not leak-tight to gases to assure fast treatment of the ambient gaseous atmosphere and elimination of pollutants affecting sensitive products packaged in the container.

The lower plane edge of the outer peripheral surface of the assembly ring (31) may be extended by a gripping visor (17), to facilitate the opening and closing manoeuvre of the stopper-cap (1).

A child safety opening system may be installed adjacent to the visor (17) to make it difficult or even impossible for children to open the stopper-cap. This device is a flexible strip (23) forming an integral part of the assembly means and in the form of a projection creating a gap between the flexible strip and the assembly means. This flexible strip is located underneath the visor following the profile such that the projection of the visor used to apply a vertical thrust to open it is surrounded by this flexible strip if there is no applied force. In this case, the visor can only be accessed after applying pressure on this strip so as to deform it and enable access to the said visor. With this means, the child is protected by the necessity to perform two complementary gestures simultaneously, the first gesture being a horizontal pressure on the flexible strip, and the second being a vertical upwards thrust on the released visor by maintaining pressure on the flexible strip.

Figure 3:
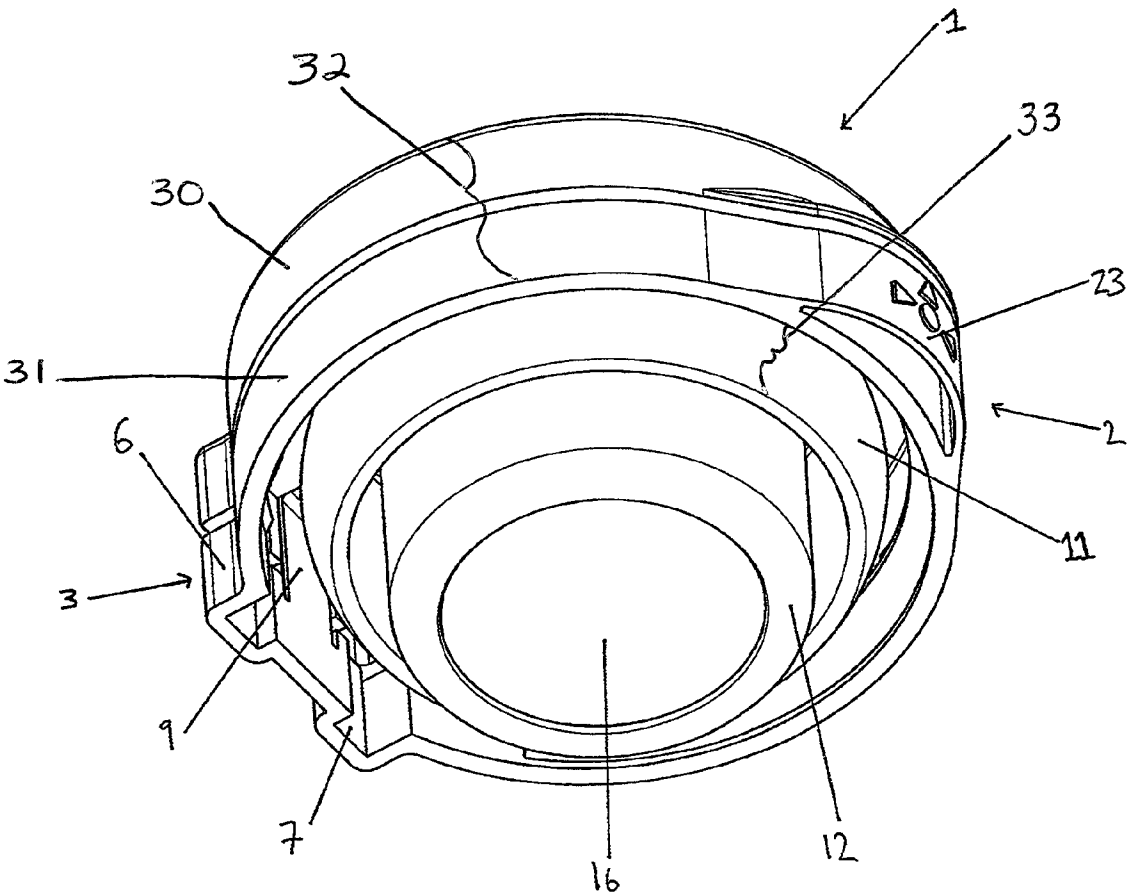
FIG. 3 is a perspective view from below of the leak-tight sealing and treatment device in the closed position, comprising a child safety opening system.
Figure 4:
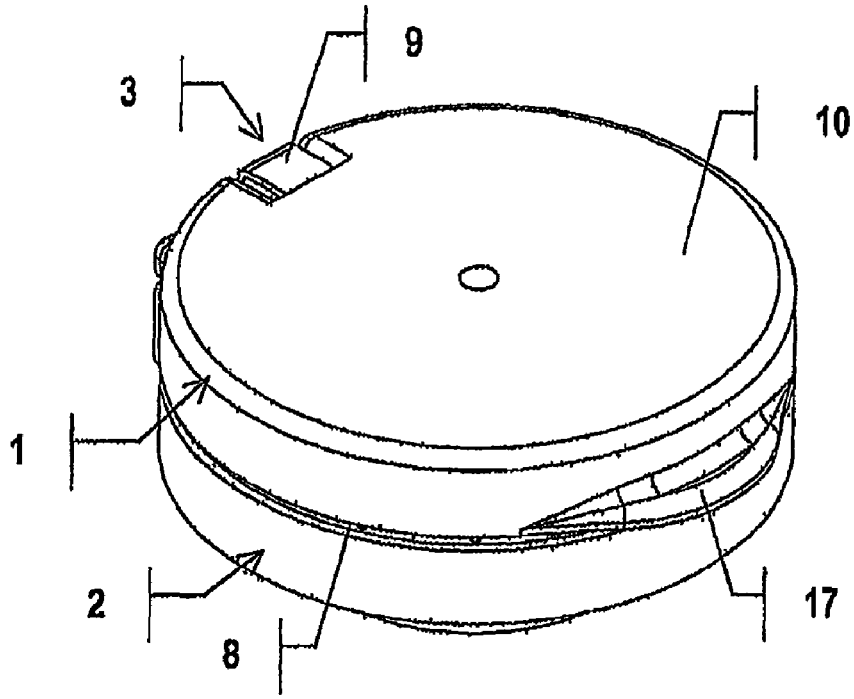
FIG. 4 is a perspective view from above oriented on the front part of the leak-tight sealing and treatment device.
Figure 5:
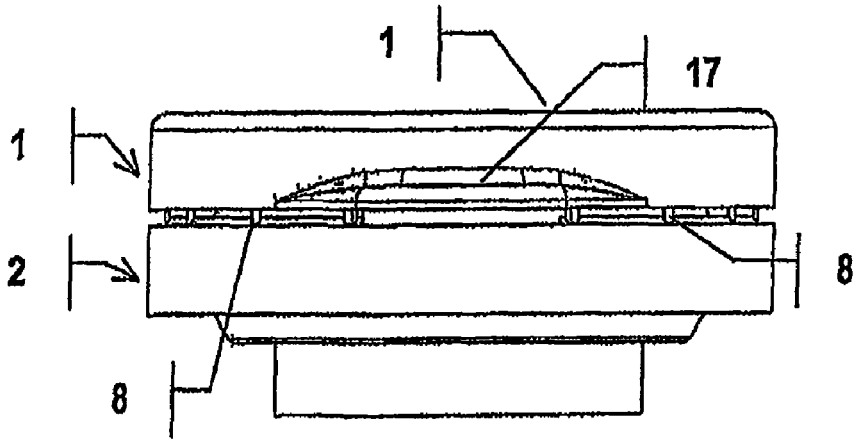
FIG. 5 is an elevation view of the front part of the leak-tight sealing and treatment device.
Figure 6:
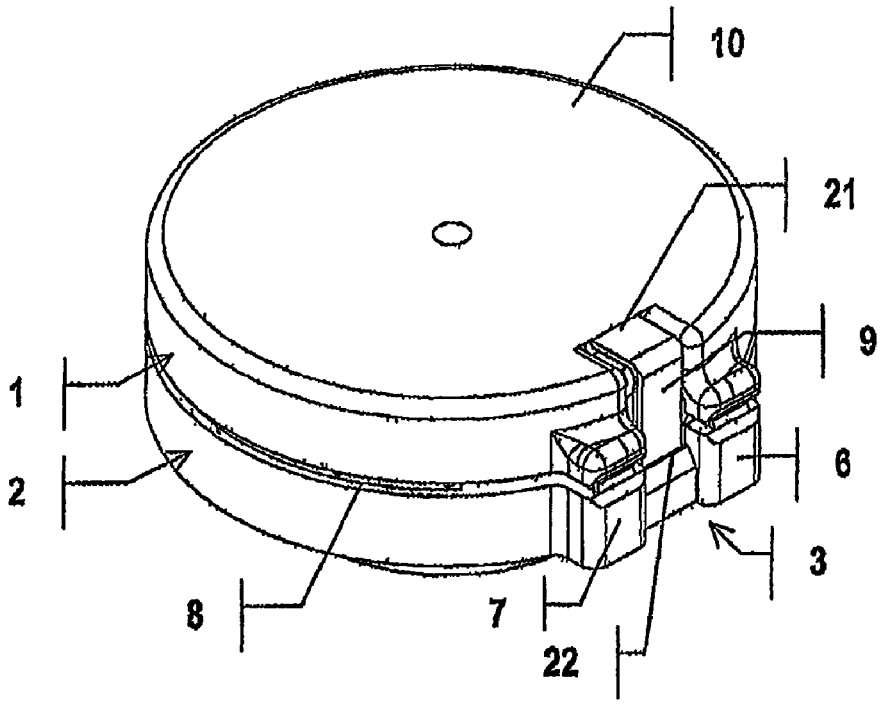
FIG. 6 is a perspective view from above oriented on the back part of the leak-tight sealing and treatment device.
Figure 7:
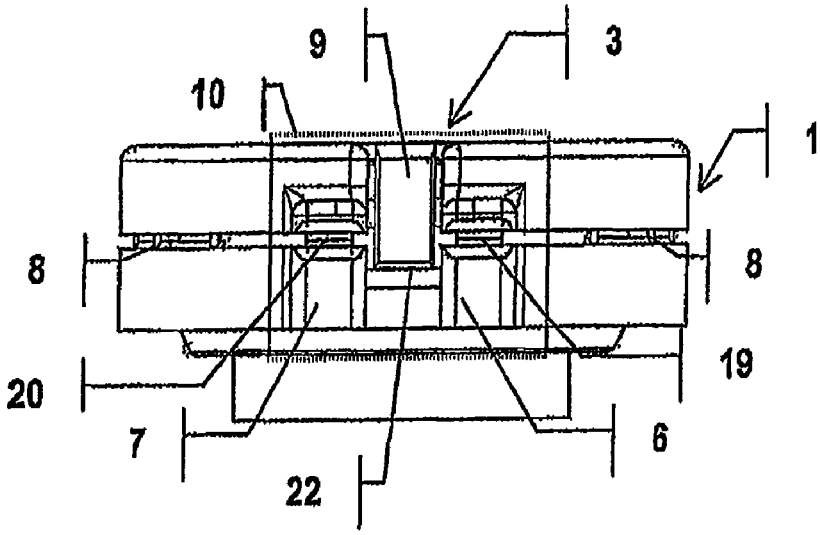
FIG. 7 is an elevation of the back part of the leak-tight sealing and treatment device.
Figure 8:
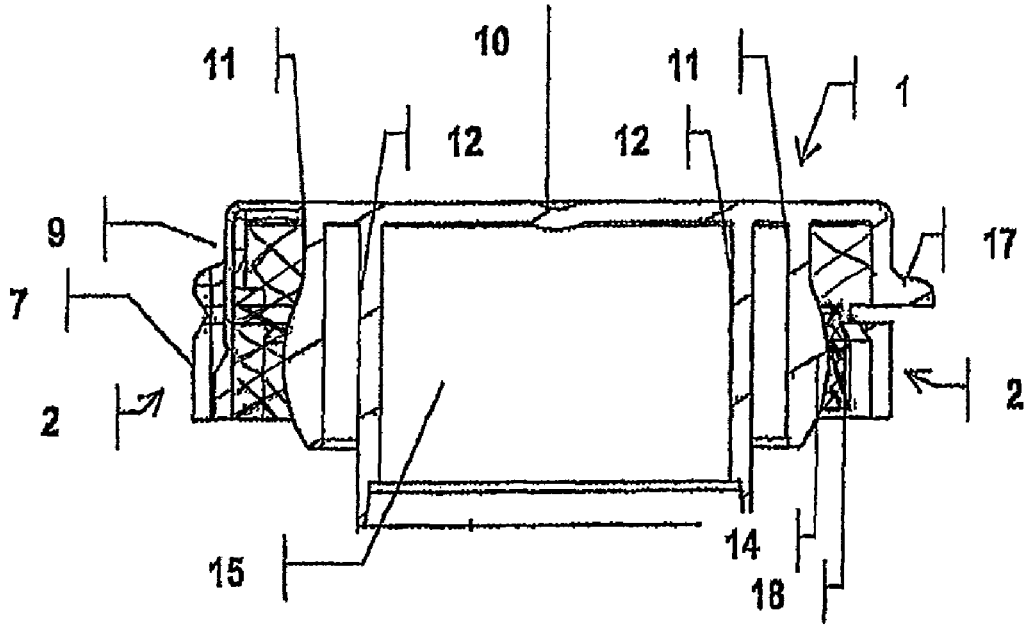
FIG. 8 is a diametric sectional view along the hinge-visor direction of the stopper-cap.
Figure 9:
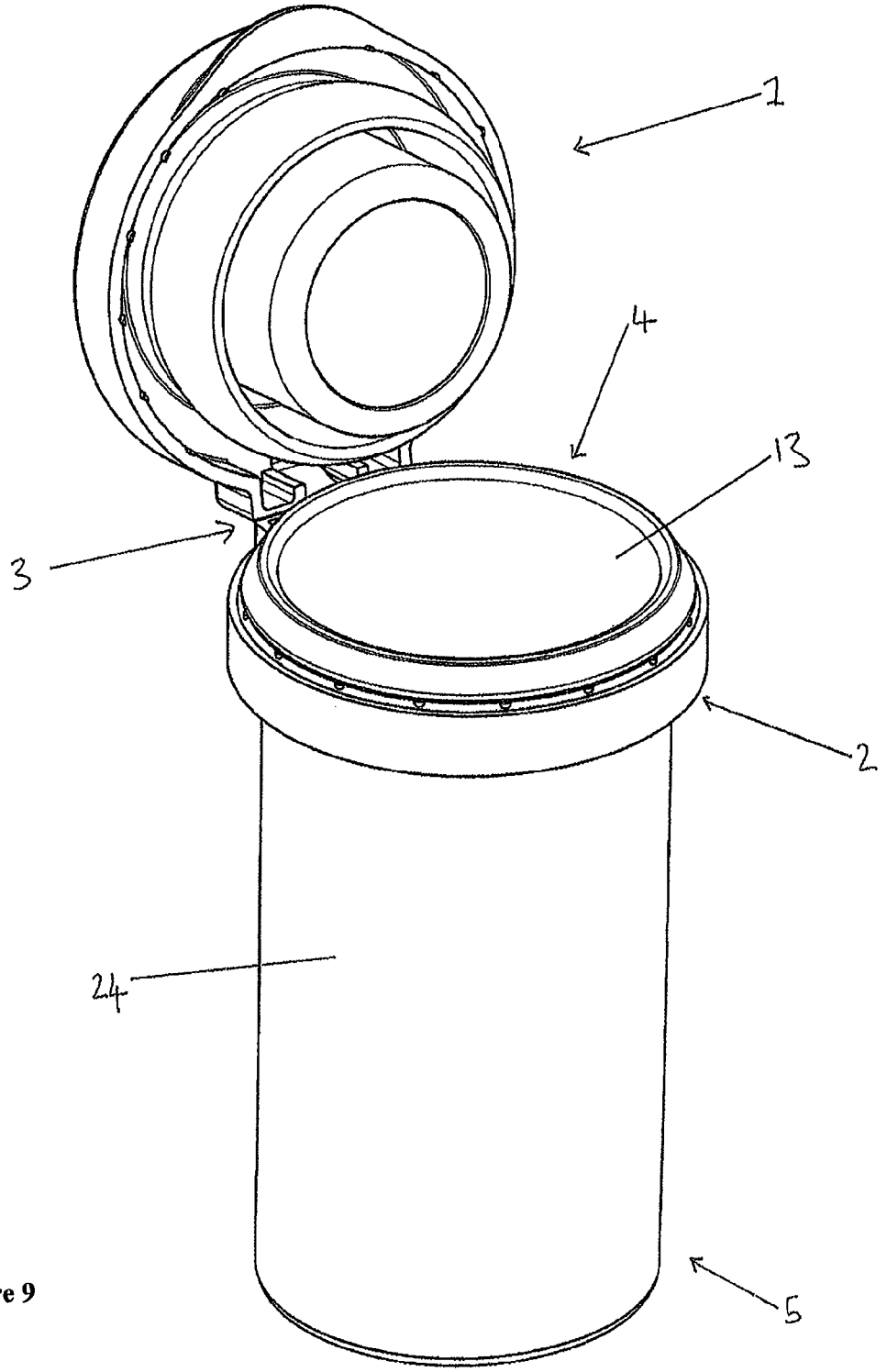
FIG. 9 is a perspective view of the leak-tight sealing and treatment device according to the invention in the open position at 120° mounted on a container with a tubular casing.
Figure 10:
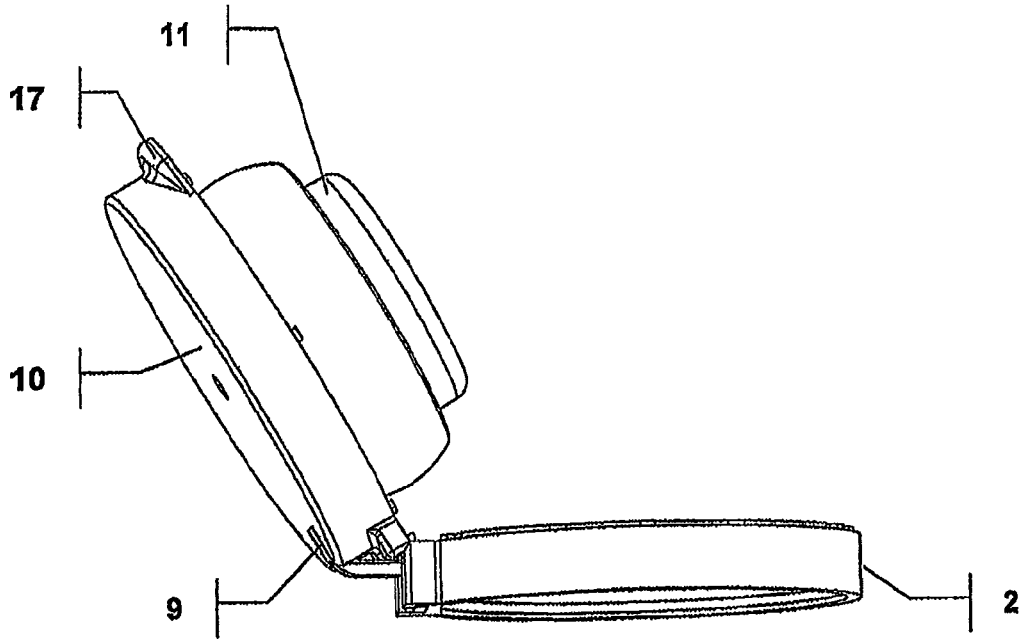
FIG. 10 is a perspective view of the side of the leak-tight sealing device in the open position.

The assembly means (2) of the stopper-cap (1) is formed from an attachment ring (2) mounted on the tubular casing of the access opening to the container to be sealed, this ring:

As shown in FIG. 3 the outer surface of the assembly ring is referred to as the outer peripheral surface (31).

being sized to match the dimensions of the tubular casing, being provided with a click fit means in relief (18) on its inner face that will come into contact with the outer surface of the casing, facing the outer face of the casing on which the opposed mating means for the ring click device is located, in other words recessed means.

Figure 11:
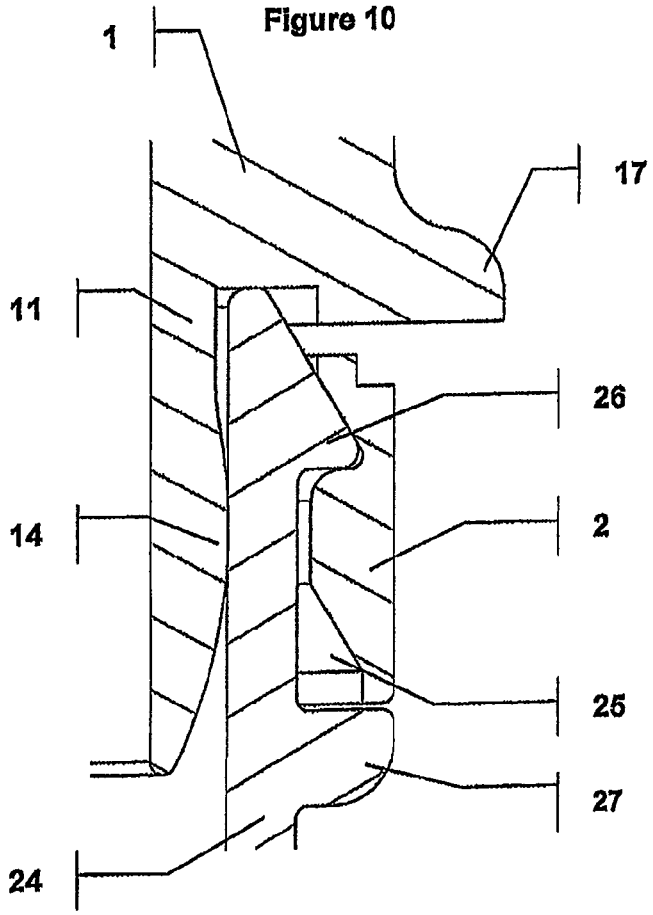
FIG. 11 is a detailed sectional view of the attachment of the ring to the container according to one variant of the invention.

According to one variant of the invention shown in FIG. 11, the outer peripheral surface of the tubular casing (24) of the access opening (4) to the container to be sealed comprises two projecting peripheral collars (26) and (27) separated from each other by creating a groove (25), with an approximately rectangular shaped section, such that:

the thickness of the tubular casing inside the groove is not modified, and the attachment ring (2) is force fitted into the said groove (25).

Figure 12:
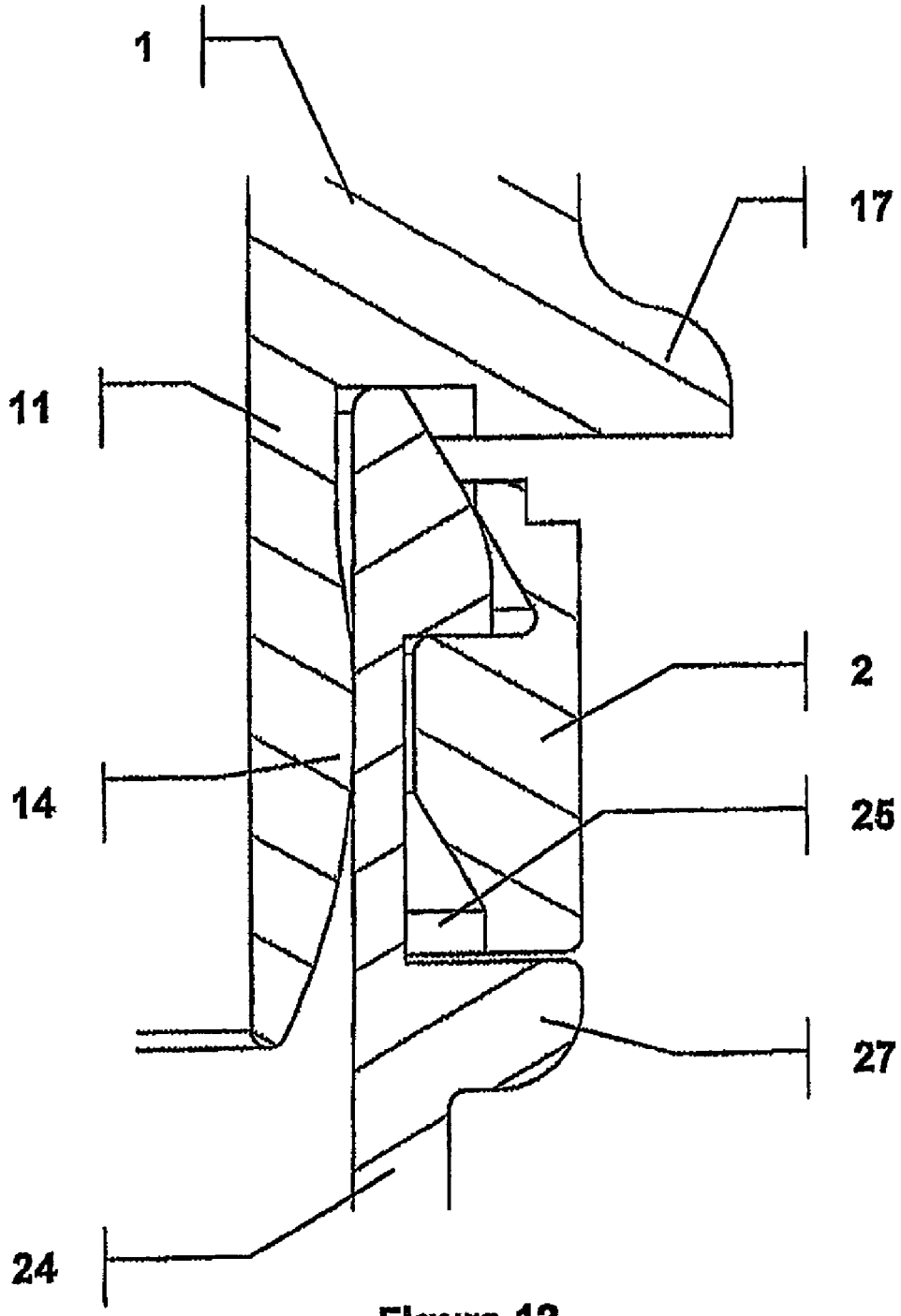
FIG. 12 is a detailed sectional view of the attachment of the ring to the container according to another variant of the invention.

According to another variant of the invention shown in FIG. 12, a peripheral groove (25) that may have an approximately rectangular, hemispherical or semi-elliptical cross-section, is made recessed in the thickness of the wall of the tubular casing (25) of the container such that:

the thickness of the tubular casing inside the groove is modified and is less than the thickness of the tubular casing and the attachment ring (2) is force fitted into the said groove (25).

The relatively rigid hinge type connecting means (3) is present between the sealing means (1) and the assembly means (2) on the tubular casing of the access opening to the container (4).

This hinge type connecting means (3) according to the invention is formed from two film hinges (6) and (7) at a spacing from each other, making the connection between the stopper-cap (1) and the attachment ring (2) rigid.

Each film hinge (6) and (7) is formed from two parts connected to each other by a polymer film acting as a rotation axis (19) and (20) enabling opening/closing cycles of the sealing means, one of the parts being integrated into the sealing means (1) and the other part being integrated into the assembly means (2).

The two parts of each of the two hinges (6) and (7) integrated into the sealing means (1) and the assembly means (2) form attachment brackets of the two film hinges on the sealing means and the assembly means.

These two types of film hinges (6) and (7) assure optimum operation when closing (and during opening) for the placement of the stopper-cap (1) on the opening (4) of the casing to be sealed by the use of a single finger of the hand holding the container, due to perfect mechanical guidance of the said stopper-cap, only requiring a downwards vertical pressure to close it, which causes click fitting of the stopper-cap.

The tamper resistance means (8) or the tamper resistance telltale is formed from micro-links connecting the lower peripheral surface (30) of the stopper-cap (1) to the outer peripheral surface (31) of the attachment ring (2), these micro-links being micro-connection dots independent of each other forming a toothed peripheral connecting ring between the drying sealing means and the assembly means on the tubular casing of the container opening, the ring being broken during the first opening by lifting the stopper-cap using the visor (17).

When the outer peripheral surface (31) of the assembly ring (2) is connected to the lower peripheral surface (30) of the stopper-cap (1), they form an outer peripheral ring (32). See FIG. 3. The outer peripheral ring forms a groove (33) with the tubular inner wall (12) which extends completely around the stopper-cap and assembly means. When the stopper-cap and assembly means are separated, this groove still exists extending completely around the stopper-cap and assembly mean.

The spring-loaded mechanical means (9) for assisted opening and closing of the drying sealing means (1) is placed in the space located between the two film hinges (6) and (7), and its cross-section is in the shape of a bracket.

This spring-loaded mechanical means (9) also controls the amplitude of the opening angle of the sealing means (1) that in this case is at 120°, such that starting from its entirely open travel position of 120°, the sealing means is easily moved in the closing direction by a finger of the hand holding the container fitted with the sealing device. When the spring-loaded mechanical means (9) or bracket is in a closed position with the stopper-cap closed on the tubular casing, the angle of the bracket is in the order of 90°. See FIG. 6.

The spring-loaded mechanical means (9) is simultaneously connected to the stopper-cap (1) by a film hinge (21) and to the attachment ring (2) of the device according to the invention by another film hinge (22).

The invention claimed is:

1. Device for leak-tight sealing of packaging containers for products sensitive to ambient pollutants with controlled amplitude of the opening angle and mechanically assisted opening and closing, to be installed on a tubular casing of an access opening to said container, said device being made in one piece of thermoplastic polymer materials and comprising:

a leak-tight sealing means of the access opening of the container, a means of assembly of the sealing means onto the tubular casing of the access opening, a connection means between the sealing means and the assembly means, a first opening tamper resistance means, placed between the sealing means and the assembly means, wherein said device comprises:

a) a male type stopper-cap as the sealing means of the opening in the tubular casing of the container, composed of an upper end wall on which a tubular outer wall is mounted setting up a leak-tight contact with the inner surface of the tubular casing of the container access opening, b) as assembly means of the sealing means, an assembly ring mounted on the tubular casing of the container access opening, the inner face of which is provided with a means of attachment to the outer face of the casing, wherein when the stopper-cap is closed upon the assembly ring, the stopper-cap and the assembly ring further comprise a lower peripheral surface of the stopper-cap and an outer peripheral surface of the assembly ring and wherein the combination of the lower peripheral surface of the stopper-cap and the outer peripheral surface of the assembly ring comprises an outer peripheral ring located outside the tubular outer wall of the stopper-cap and thereby forming a groove comprising the outer peripheral ring and the tubular outer wall, which groove extends completely around the stopper-cap and assembly ring from the outer peripheral ring to the tubular outer wall of the stopper-cap, c) as connection means between the assembly means and the sealing means, two distinct hinges at a spacing from each other, wherein the two distinct hinges comprise film hinges, each of which is formed of two parts forming brackets joined together by a polymer film acting as an axis of rotation allowing the opening/closing cycles of the sealing means, one of the parts being integrated into the sealing means and comprising a portion of the outer peripheral ring with the other part integrated into the assembly means, d) as first opening tamper resistance means, a peripheral series of connecting micro-dots or a peripheral strip to be torn off, or a combination of these two means placed between the sealing means and the assembly means so that the lower peripheral surface of the stopper-cap is joined to the outer peripheral surface of the assembly ring to form the outer peripheral ring, e) a mechanical assistance means for opening and closing and controlling the amplitude of the opening angle of the stopper-cap, placed in the space located between the two hinges and simultaneously connected to the stopper-cap and comprising an element of the outer peripheral ring through a further film hinge, and to the attachment ring fastening the device onto the casing by another film hinge, the section through the said mechanical assistance means being in the form of a bracket, wherein, when viewed in a diametric section passing between the film hinges of the connecting means, the another film hinge of the mechanical assistance means and the part of the bracket joined to the assembly means are radially offset so as to be internal to the parts of the film hinges of the connecting means, which are integrated with the assembly means.

2. Device according to claim 1, wherein the cross-section of the tubular outer wall of the sealing means setting up the leak-tight contact with the inner surface of the tubular casing of the opening of the container includes a peripheral swelling developing on an outer face thereof.

3. Device according to claim 2, wherein the outer peripheral swelling of the tubular outer wall is deformed when in contact with the inner wall of the tubular casing of the opening.

4. The device of claim 1 further comprising a means for packaging an ambient air treatment agent on its inner face, wherein a tubular inner wall of the male type stopper-cap internal to the tubular outer wall forms the packaging means for an ambient air treatment.

5. Device according to claim 4, wherein the packaging means of ambient air treatment agents, contains treatment agents capable of eliminating gaseous pollutants, water vapour, oxygen ($O_2$), ammonia ($NH_3$), alcohols, aldehydes, ketones, sulphur dioxide ($SO_2$), hydrogen sulphide ($H_2S$), mercaptans, alkenes, alkynes, carbon dioxide ($CO_2$), carbon monoxide (CO), nitrogen dioxide ($NO_2$), alkanes, halogens, and/or bacteria present in the ambient air.

6. Device according to claim 5, wherein when the pollutant is water vapour, the treatment agent is selected from the group consisting of silica gels and molecular sieves in powdery form or deposited on a powdery support.

7. Device according to claim 1, wherein the stopper-cap is provided with a gripping visor.

8. Device according to claim 1, wherein the stopper-cap is provided with a child opening safety system.

9. Device according to claim 8, wherein the safety system is installed adjacent to the visor.

10. Device according to claim 8, wherein the opening safety system is a flexible strip surrounding the visor and forming an integral part of the assembly means.

11. Device according to claim 1, wherein the inner face of the stopper-cap tubular outer wall and the outer face of the outer wall of the tubular casing of the access opening of the container are provided with a click fit means.

12. Device according to claim 1, wherein the assembly means of the stopper-cap is an attachment ring mounted on the tubular casing of the access opening, provided with a click fit means on its inner face facing the outer face of the tubular casing, on which there is also a click fit means.

13. Device according to claim 1, wherein the assembly means is force fitted on the tubular casing.

14. Device according to claim 1, wherein the assembly means is mounted by bonding on the tubular casing.

15. Device according to claim 1, wherein the outer peripheral surface of the tubular casing of the access opening to the container to be sealed comprises two projecting peripheral collars, separated from each other by creating a groove with an approximately rectangular shaped section, the thickness of the tubular casing inside the groove is not modified, and the attachment ring is force fitted into the said groove.

16. Device according to claim 1, wherein a peripheral groove that may have an approximately rectangular, hemispherical or semi-elliptical shaped section, is made recessed within the thickness of the wall of the tubular casing of the container, the thickness of the tubular casing inside the groove being modified, and being less than the thickness of the tubular casing and the attachment ring force fitted into the said groove.

17. Device according to claim 15, wherein the inner surface of the attachment ring is provided with click fit means which, when the said attachment ring is force fitted into the groove of the container, itself equipped with complementary click fit means, fits into the corresponding click fit means so as to block any rotation or translation of the stopper with respect to the container.

18. Device according to claim 17, wherein the said click fit means on the inner surface of the attachment ring and on the inner surface of the groove in the container are splines or slots.

19. Device according to claim 1, wherein the amplitude of the opening angle controlled by the mechanical assistance means is not more than 160°.

20. Device for leak-tight sealing of packaging containers for products sensitive to ambient pollutants with controlled amplitude of the opening angle and mechanically assisted opening and closing, to be installed on a tubular casing of an access opening to said container, said device being made in one piece of thermoplastic polymer materials and comprising:

a leak-tight sealing means of the access opening of the container, a means of assembly of the sealing means onto the tubular casing of the access opening, a connection means between the sealing means and the assembly means, a first opening tamper resistance means, placed between the sealing means and the assembly means, wherein said device comprises:

a) a male type stopper-cap as the sealing means of the opening in the tubular casing of the container, composed of an upper end wall on which a tubular outer wall is mounted setting up a leak-tight contact with the inner surface of the tubular casing of the container access opening, b) as assembly means of the sealing means, an assembly ring mounted on the tubular casing of the container access opening, the inner face of which is provided with a means of attachment to the outer face of the casing, c) as connection means between the assembly means and the sealing means, two distinct hinges at a spacing from each other, wherein the two distinct hinges comprise film hinges, each of which is formed of two parts forming brackets joined together by a polymer film acting as an axis of rotation allowing the opening/closing cycles of the sealing means, one of the parts being integrated into the sealing means with the other part integrated into the assembly means, d) as first opening tamper resistance means, a peripheral series of connecting micro-dots or a peripheral strip to be torn off, or a combination of these two means placed between the sealing means and the assembly means so that the lower peripheral surface of the stopper-cap is joined to an outer peripheral surface of the assembly means, e) a mechanical assistance means for opening and closing and controlling the amplitude of the opening angle of the sealing means, placed in the space located between the two hinges and simultaneously connected to the stopper-cap through a further film hinge, and to the attachment ring fastening the device onto the casing by another film hinge, the section through the said mechanical assistance means being in the form of a bracket, wherein, when viewed in a diametric section passing between the film hinges of the connecting means, the another film hinge of the mechanical assistance means and the part of the bracket joined to the assembly means are radially offset so as to be internal to the parts of the film hinges of the connecting means, which are integrated with the assembly means;

wherein the bracket of the mechanical assistance means is formed with an angle in the order of 90° when the stopper-cap is closed upon the tubular casing, which bracket can be deformed in an angle of not more than 15° on each end of the bracket as the stopper-cap is being opened.

21. Device according to claim 1, wherein said device is made from thermoplastic polymer composition selected from the group consisting of polyethylenes (PE), polypropylenes (PP), ethylene/propylene copolymers and blends of them, polyamides (PA), polystyrenes (PS), acrylonitrile-butadiene-styrene (ABS) copolymers, styrene-acrylonitrile (SAN) copolymers, polyvinyl chlorides (PVC), polycarbonates (PC), polymethyl methacrylate (PMMA), and polyethylene terephthalates (PET) used alone or mixed.

22. Device according to claim 21, wherein at least one natural or synthetic thermoplastic elastomer is associated with the thermoplastic compositions, the elastomer used being selected from the group consisting of natural rubber or synthetic rubber type elastomers, and rubbers based on mono-olefins, diolefin rubbers, rubbers based on condensation products, thermoplastic rubbers, silicones, styrenic rubbers, styrene-butadiene-styrene (SBS) and styrene-isoprene-styrene (SIS).

23. Device according to claim 1 wherein said device is made in a single part according to plastics methodologies.

24. A method for leak-tight sealing and ambient air purification treatment of packaging containers for products sensitive to gaseous pollutants comprising utilizing a device according to claim 1.

25. Device according to claim 21, wherein at least one natural or synthetic thermoplastic elastomer is associated with the thermoplastic compositions, the elastomer being at least one selected from the group composed consisting of isobutene/isoprene polymers, ethylene vinyl acetate (EVA), ethylene-propylene (EPR), ethylene-propylene-diene (EPDM), ethylene-acrylic esters (EMA-EEA), fluorinated polymers, polybutadienes, styrene-butadiene (SBR) copolymers, polyester, polyurethane, thermoplastic rubbers, silicones, styrenic rubbers, styrene-butadiene-styrene (SBS) and styrene-isoprene-styrene (SIS).

26. Device for leak-tight sealing of packaging containers for products sensitive to ambient pollutants with controlled amplitude of the opening angle and mechanically assisted opening and closing, to be installed on a tubular casing of an access opening to said container, said device being made in one piece of thermoplastic polymer materials and comprising:

a leak-tight sealing means of the access opening of the container, a means of assembly of the sealing means onto the tubular casing of the access opening, a connection means between the sealing means and the assembly means, a first opening tamper resistance means, placed between the sealing means and the assembly means, wherein said device comprises:

a) a male type stopper-cap as the sealing means of the opening in the tubular casing of the container, composed of an upper end wall on which a tubular outer wall is mounted setting up a leak-tight contact with the inner surface of the tubular casing of the container access opening, wherein the stopper-cap further comprises a lower peripheral surface of the stopper-cap located outside the tubular outer wall and forming a groove with the tubular outer wall extending completely around the stopper-cap from the lower peripheral surface of the stopper-cap to the tubular outer wall of the stopper-cap, b) as assembly means of the sealing means, an assembly ring mounted on the tubular casing of the container access opening, the inner face of which is provided with a means of attachment to the outer face of the casing, c) as connection means between the assembly means and the sealing means, two distinct hinges at a spacing from each other, wherein the two distinct hinges comprise film hinges, each of which is formed of two parts forming brackets joined together by a polymer film acting as an axis of rotation allowing the opening/closing cycles of the sealing means, one of the parts being integrated into the sealing means and comprising a portion of the lower peripheral surface of the stopper-cap with the other part integrated into the assembly means, d) as first opening tamper resistance means, a peripheral series of connecting micro-dots or a peripheral strip to be torn off, or a combination of these two means placed between the sealing means and the assembly means so that the lower peripheral surface of the stopper-cap is joined to an outer peripheral surface of the assembly means, e) a mechanical assistance means for opening and closing and controlling the amplitude of the opening angle of the stopper-cap, placed in the space located between the two hinges and simultaneously connected to the stopper-cap and comprising an element of the outer peripheral ring through a further film hinge, and to the attachment ring fastening the device onto the casing by another film hinge, the section through the said mechanical assistance means being in the form of a bracket, wherein, when viewed in a diametric section passing between the film hinges of the connecting means, the another film hinge of the mechanical assistance means and the part of the bracket joined to the assembly means are radially offset so as to be internal to the parts of the film hinges of the connecting means, which are integrated with the assembly means.

* * * * *